United States Patent [19]

White

[11] 4,278,316

[45] Jul. 14, 1981

[54] REJECTOR FUSE CLIP ASSEMBLY

[75] Inventor: Raymond R. White, Cincinnati, Ohio

[73] Assignee: Ilsco Corporation, Cincinnati, Ohio

[21] Appl. No.: 678,977

[22] Filed: Apr. 21, 1976

[51] Int. Cl.[3] ..... H01C 1/02

[52] U.S. Cl. ..... 339/258 R; 339/259 R; 337/252

[58] Field of Search ..... 339/147 R, 150 A, 147 P, 339/184 R, 186 R, 219 F, 258 F, 253, 258, 259; 337/210, 215, 225, 226, 227, 231, 233, 234, 236, 237, 248, 251, 252, 260, 261

[56] References Cited

U.S. PATENT DOCUMENTS

| | | | |
|---|---|---|---|
| 2,422,589 | 6/1947 | Samzelius | 339/219 F |
| 2,943,295 | 6/1960 | Stewart | 339/258 F |
| 3,914,005 | 10/1975 | Tillson | 339/258 F X |

*Primary Examiner*—George Harris

*Attorney, Agent, or Firm*—Wood, Herron & Evans

[57] ABSTRACT

A novel two-piece rejector fuse clip assembly comprised of a rejector clip and a fuse clip in structural combination. A separate and structurally rigid rejector clip includes a pair of opposed and coplanar ears positioned to define an open-ended slot running therebetween, the slot being sized to receive a fuse's grooved ferrule, but to refuse a fuse's non-grooved ferrule when the basic ferrule diameters are equal. The rejector clip's ears are connected, through shoulders, to a rear face disposed parallel to and spaced from the front face, thereby providing a generally C-shaped rejector clip configuration when viewed from the top. The separte fuse clip includes spring legs, vertical slots being provided in those legs to receive the rejector clip's ears, thereby connecting the rejector clip and fuse clip in operable combination. The fuse clip's legs are squeezed inward toward one another to permit assembly of the rejector and fuse clips, the legs springing back outward after assembly to restrict disassembly of the clips. A foot extends from the bottom edge of the rejection clip's rear face, same presenting a mounting hole that overlies a similar mounting hole centered in the fuse clip's base, thereby permitting field assembly of the rejector clip in the fuse clip on an electrically conductive mounting strap of a fuse block, which assembly exhibits uniformity in electrical contact between the fuse clip and mounting strap over the entirety of their mating surfaces.

7 Claims, 5 Drawing Figures

REJECTOR FUSE CLIP ASSEMBLY

This invention relates to fuse clips. More particularly, this invention relates to a novel fuse clip structure having a fuse rejection capability.

Fuse clips, of course, are very well known to the prior art. Basically, a fuse clip is a U-shaped member in which upstanding spring legs of the clip are especially configured to embrace, in electrical contact relation, the ferrule end of a cartridge fuse. The base of the fuse clip is adapted to be mounted to a fuse block, or the like, by a screw or other type of fastener element, thereby fixing the fuse clip in operational position.

While the basic fuse clip structure has been known for many years, a given size fuse clip is suitable for use with, and will receive in seated electrical relation therewith, any cartridge fuse of the requisite ferrule diameter. However, in certain installations such may cause problems as, for example, cartridge fuses of different electrical characteristics may have the same ferrule diameter. In recent years it has become known to differentiate between fuses of different electrical characteristics, but of the same ferrule diameter, by providing a groove on one end of one type fuse, and no groove on either end of another type fuse. To accommodate this groove concept on cartridge fuses, rejector fuse clips were developed.

Rejector fuse clips are also well known to the prior art. Basically, a rejector fuse clip comprises a fuse clip of the conventional or historical type, as described above, with some kind of interference structure provided in combination with the spring legs of the fuse clip. The interference structure interrelates with the ferrule end of a cartridge fuse to prevent insertion in the rejector fuse clip of a fuse without a groove. Of course, if insertion of a fuse without a groove is desired, the interference structure must be removed from the fuse clip. Such a rejector fuse clip prevents insertion of an improper fuse, i.e., a fuse not designed for use with the particular electrical system under review. Typical of rejector fuse clips known to the prior art are those illustrated in U.S. Pat. No. 2,943,295 and U.S. Pat. No. 1,953,343. These prior art rejector fuse clips, while in fact providing a fuse rejector-type function to the fuse clip, have inherent disadvantages relative to applicant's rejector fuse clip assembly which, in applicant's view, makes same not as desirable from a commercial operating standpoint as is applicant's rejector fuse clip assembly.

Accordingly, it has been one objective of this invention to provide a novel rejector fuse clip assembly, that novel assembly serving to reject cartridge-type fuses without a grooved ferrule end.

It has been another objective of this invention to provide a novel rejector fuse clip assembly, that rejector fuse clip assembly being comprised of a separate fuse clip and a separate rejector clip, which clips are assembled one with another by squeezing the legs of the fuse clip toward one another, as opposed to springing same outwardly away from one another.

It has been a further objective of this invention to provide a novel rejector fuse clip assembly, that rejection fuse clip assembly being comprised of a separate fuse clip and a separate rejection clip, in which the rejection clip provides a shoulder structure which, when the rejection clip and fuse clip are assembled in operational relation, permits the outward stressing or springing of the fuse clip's legs only to the extent necessary to accommodate installation of the desired cartridge fuse size.

It has been still another objective of this invention to provide a novel rejector fuse clip assembly which permits the separate rejector clip and the separate fuse clip to be screw-mounted onto a mounting surface, e.g., a fuse block or the like, on a common screw axis centrally located in the base of the fuse clip, thereby insuring uniform electrical contact of the fuse clip's base with the electrical contact surface associated therewith over the entirety of their mating surfaces.

In accord with these objectives, the novel two-piece rejector fuse clip assembly of this invention is basically comprised of a rejector clip and a fuse clip in structural combination. In preferred form, the separate and structurally rigid rejector clip includes a pair of opposed and coplanar ears positioned to define an open-ended slot running therebetween, the slot being sized to receive a fuse's grooved ferrule, but to refuse a fuse's non-grooved ferrule when the basic ferrule diameters are equal. The rejector clip's ears are connected, through shoulders, to a rear face disposed parallel to, and spaced from, the front face, thereby providing a generally C-shaped rejector clip configuration when viewed from the top. Also in preferred form, the separate fuse clip includes spring legs, vertical slots being provided in those legs to receive the rejector clip's ears, thereby connecting the rejector clip and fuse clip in operable combination. The fuse clip's legs are squeezed inward toward one another to permit assembly of the rejector and fuse clips, the legs springing back outward after assembly to restrict disassembly of the clips. A foot extends from the bottom edge of the rejection clip's rear face, same presenting a mounting hole that overlies a similar mounting hole centered in the fuse clip's base, thereby permitting field assembly of the rejector clip in a fuse clip on an electrically conductive mounting strap of a fuse block, which assembly exhibits uniform electrical contact between the fuse clip and the mounting strap over the entirety of their mating surfaces.

The rejector fuse clip assembly of this invention will be more apparent from the following detailed description of the invention taken in conjunction with the drawings in which.

Figure 1:
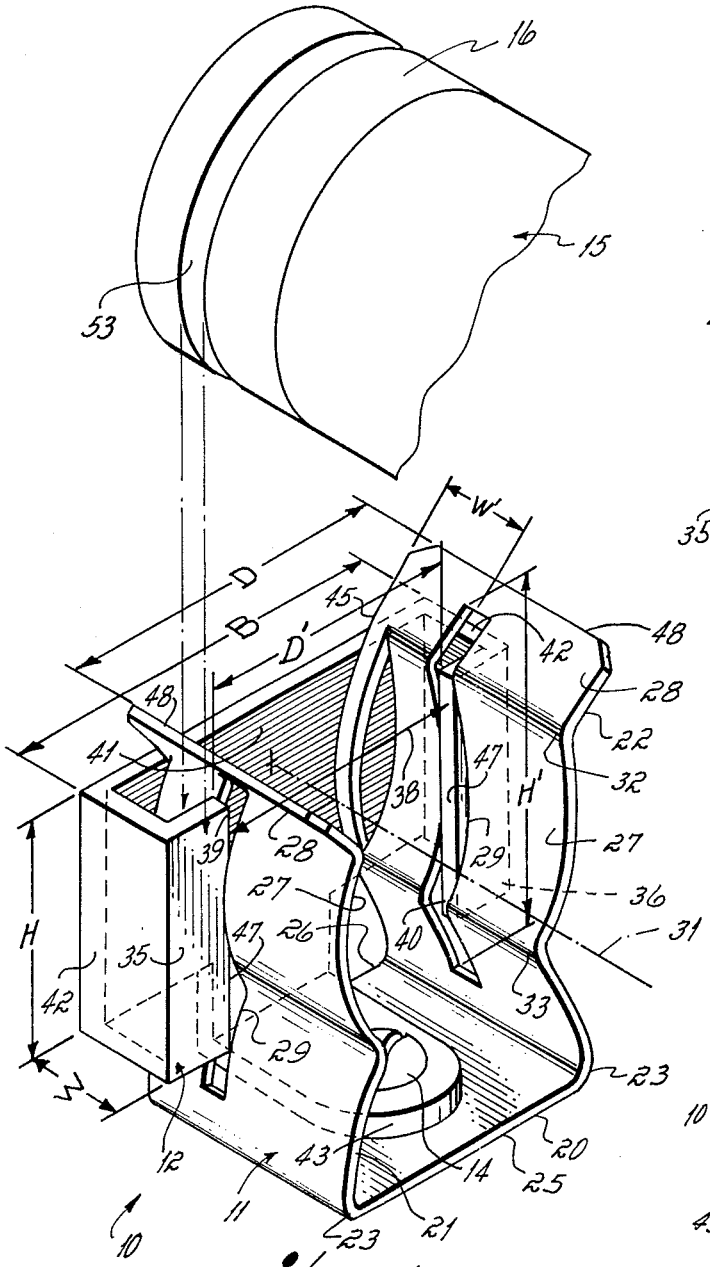
FIG. 1 is a perspective view illustrating a rejector fuse clip assembly structured in accord with the principles of this invention.

The rejector fuse clip assembly 10 of this invention is basically a two-part assembly structure. One part of the assembly structure is fuse clip 11 and the other part of the assembly structure is rejection clip 12. Both fuse 11 and rejection 12 clips are adapted for mounting in combination with, e.g., fuse block 13, and are restrained in assembly one with the other, in operational use through use of a single screw 14. The fuse clip 11 is of the type adapted for use with a cartridge fuse 15, a non-grooved or plain ferrule end (not shown) of the cartridge fuse being receivable in the fuse clip 11 when same is not used in combination with the rejector clip 12, and the grooved ferrule end 16 of a cartridge fuse being receivable in the fuse clip when same is used in combination with the rejector clip.

Figure 2:
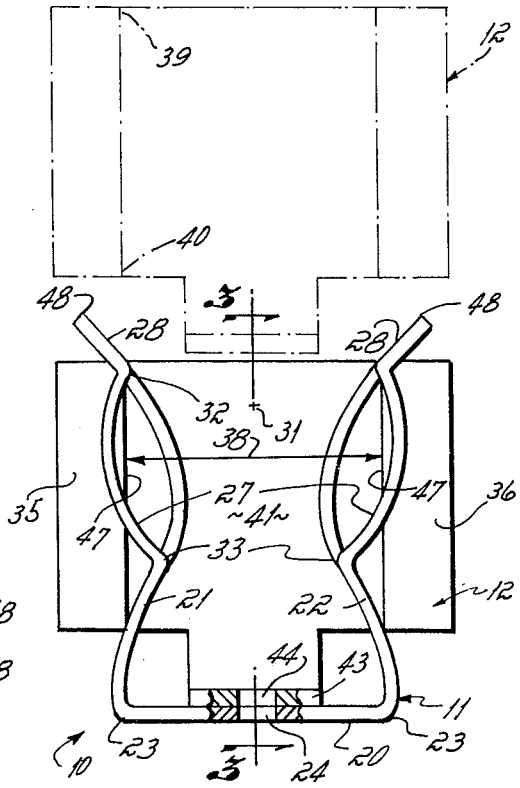
FIG. 2 is a front view of the rejector fuse clip illustrated in FIG. 1 and showing assembly of the rejector clip with the fuse clip.

The fuse clip 11 is of a generally U-shaped configuration that basically includes a generally planar base 20 portion with a spring leg 21, 22 extending upwardly from each side edge 23 of that base portion (see FIGS. 1 and 2). A screw hole 24 is centrally positioned in the base 20 of the fuse clip 11, the screw hole being centrally located relative to the side 23, leading 25 and trailing 26 edges of the fuse clip.

Each of the fuse clip's spring legs 21, 22 is outwardly bowed or curved to establish a contact surface 27 intermediate the top and bottom portions thereof, the two outwardly bowed contacts' surfaces being configured to receive ferrule end 16 of a cartridge ferrule in electrical contact therewith, see FIGS. 1 and 2. The top edge portion of each spring leg 21, 22 is outwardly flared as at 28 so as to facilitate insertion of the cartridge fuse's ferrule end 16 into electrical contact with the fuse clip's legs 21, 22.

Figure 3:
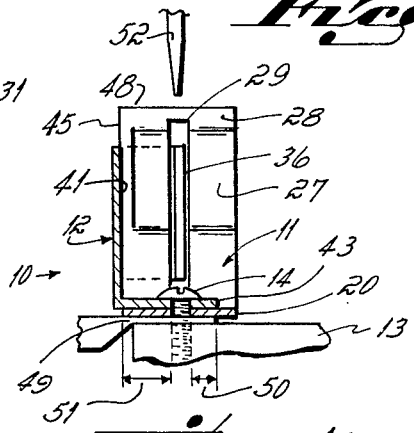
FIG. 3 is a cross-sectional view taken along line 3—3 of FIG. 2, and showing attachment of the rejector fuse clip assembly to a fuse block.
Figure 4:
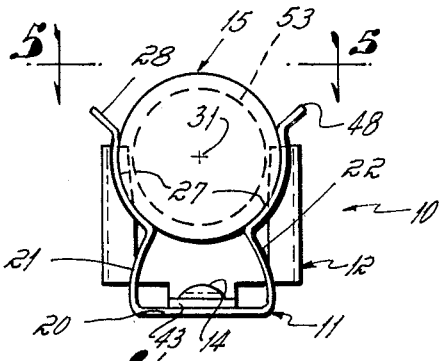
FIG. 4 is a front view similar to FIG. 2, but showing installation of a cartridge fuse with the rejector fuse clip assembly after fixing of that assembly in place on a fuse block.

Further, and importantly relative to the rejector clip 12, the fuse clip 11 is provided with a vertical slot 29 (i.e., vertical relative to the fuse clip's base 20) in each of the spring legs 21, 22, see FIGS. 1 and 3. The slots 29 are disposed in a common plane 30 transverse to the cartridge fuse axis 31 of the spring clip 11. Each slot 29 extends from the top 32 to the bottom 33 of the outwardly bowed portion 27 of its respective leg 21, 22, and is located substantially midway between leading 25 and trailing 26 edges of the fuse clip 11 relative to the axis 31 of the fuse clip. Note the center of the screw hole 24 in the fuse clip's base 20 lies in the plane 30 of the fuse clip's slots 29, although same may be removed therefrom, see FIG. 3.

Figure 5:
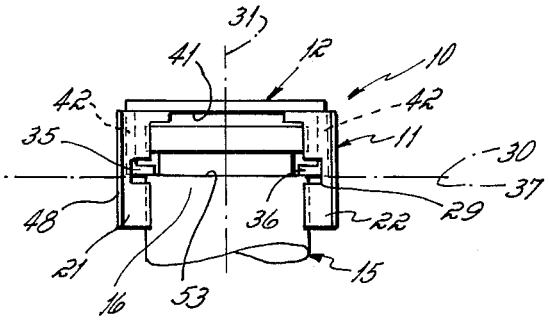
FIG. 5 is an elevational view taken along line 5—5 of FIG. 4.

The rejector clip 12 is of a rigid structure throughout, i.e., has no bendable parts analogous to spring legs 21, 22 of the fuse clip 11. This rejector clip 12 is of a novel structure which permits same to cooperate with the fuse clip 11 in a novel manner not herefore known to the art. The rejector clip 12, which is a separate clip from the fuse clip 11, basically includes, as the rejector elements, opposed ears 35, 36 disposed in a common plane 37 to define the front face of the rejector clip, see FIGS. 1 and 5. The ears are separated one from the other by a vertical slot 38 (i.e., vertical relative to the fuse clip's base 20) open at both ends, i.e., open at the top 39 and at the bottom 40. Each ear 35, 36 is connected with a rear face 41 through a shoulder 42, the rear face being disposed parallel to, yet spaced from, the plane 37 of the rejector clip 12 as defined by ears 35, 36. The overall general configuration of the rejector clip 12, when viewed from the top thereof as shown in FIG. 5, is in the general nature of a block C. The height H of the rejection clip's ears 35, 36 should be slightly less than the height H' of the respective slots 29 in the fuse clip 11 itself. Further, the width W of the rejector clip's shoulders 42 should be slightly greater than the distance W' from the rear edge 45 of the fuse clip to the slot 29. This dimensional relationship of the rejector clip 12 to the fuse clip 11 is important to permit assembly of the rejector clip 12 in operational combination with the fuse clip 11, as described below.

The rejector clip 12 also includes a foot 43 connected to, and extending forwardly from, the rear face 41, see FIGS. 1 and 3. The foot 43 includes a screw hole 44 for mounting the rejector clip 12 in fixed relation with fuse block 13. The center of the foot's screw hole 44 is positioned within the rejector clip's front plane 37, and is also located intermediate the interior side edges 47 of the ears 35, 36, thereby locating the screw hole 44 centrally of the rejector clip's slots 38.

After fabrication of the rejector clip 12 and of the fuse clip 11 separate one from the other, same must, of course, be assembled to establish the rejector fuse clip assembly 10. As shown in FIG. 2, the first assembly step requires pressing, or squeezing together, the fuse clip's spring legs 21, 22 toward one another so that the distance D between the fuse clip's top edges 48 is slightly less than the distance D' between vertical and parallel inside edges 47 of the rejector clip's ears 35, 36. Thereafter, the rejection clip 12 is positioned in the phantom-line position shown in FIG. 2 with the rejection clip's front face plane 37 being oriented coplanar with the fuse clip's slot plane 30, and with the rejector clip's slot 38 vertically oriented relative to the fuse clip's base 20. The rejector clip 12 is then moved down over the top edges 48 of the fuse clip 11 until the rejector clip's ears 35, 36 are aligned with the fuse clip's slots 29, i.e., until the rejector clip's foot 43 rests on the fuse clip's base 20. The fuse clip's legs 21, 22 are then released, same springing outwardly into the normal or non-stressed fuse clip 11 attitude because of the inherent spring in the legs. This simple assembly method locates and restrains the rejector clip's ears 35, 36, i.e., the rejector interference means for the rejector fuse clip assembly, in assembled relation with the fuse clip. As mentioned, the fuse clip's legs 21, 22 are squeezed inward upon assembly of the fuse clip 11 with the rejector clip 12. This is a safety feature in that it eliminates any chance of the fuse clip's legs 21, 22 being sprung outwardly (such as might occur if the legs 21, 22 were stressed or bent outwardly out of shape beyond the spring return point). Of course, if the fuse clip's legs 21, 22 were sprung outwardly out of shape, then the frictional contact, and hence, good electrical contact, between the fuse's ferrule end 16 and the fuse clip's legs would be impaired during use.

In assembled relation, the fuse clip 11 and the rejector clip 12 are as illustrated in FIGS. 1 and 3–5. Note that the rejector clip's rear face 41 is located axially beyond, or outside of, the fuse clip 11 relative to a cartridge fuse 15 to be received therein. Note also that the rejector clip's shoulders 42 embrace, i.e., are located outside of, the fuse clip's legs 21, 22. In other words, the rigid connector structure, i.e., rear face 41 and shoulders 42, connecting ears 35, 36 one with the other is located exteriorly of, or outside of, the fuse clip 11, i.e., partially surrounds the fuse clip to the sides and rear thereof relative to a cartridge fuse 15 received in the fuse clip. This exterior structural relationship of a rejector clip's shoulders 42 with the fuse clip's legs 21, 22 serves to provide an outbound limit (because of the rejector clip's rigidity) to the outwardly bending permitted in the fuse clip's legs 21, 22 upon installation of a fuse's ferrule end 16 in the rejector fuse clip assembly 10. Such a structural relation, therefore, sets a discrete limit to the bending permitted the legs 21, 22 so that the fuse clip 11 cannot be sprung through use with a larger fuse ferrule than that for which same is designed. In other words, the breadth B of the rejector clip's rear face may be sized so as to permit the minimum necessary outward springing of the fuse clip's legs 21, 22 to accommodate installation of that size cartridge fuse for which the rejector fuse clip assembly 10 is particularly designed. This is a safety feature in that it insures good electrical contact will be maintained between the bowed portions 27 of the fuse clip's legs 21, 22 and the fuse's ferrule 16 because it insures that the spring clip's legs will not have been unduly sprung outward by an oversized fuse.

In use, rejector fuse clip assembly 10 is mounted on a fuse block 13 through use of a one-way screw 14, a mounting strap 49 being interposed between the fuse clip's base 20 and the fuse block, see FIG. 3. As previously mentioned, note that the one-way screw 14 is centered relative to the base 20 of the fuse clip 11 itself. This centering of the mounting screw 14 relative to the fuse clip's base 20 insures good electrical contact between the fuse clip's base and the mounting strap 49 in that contact area 50 in front of the mounting screw as well as in that contact area 51 to the rear of the mounting screw, thereby utilizing the entire bottom surface of the fuse clip's base to provide that electrical contact. The single mounting screw 14 also fixes the rejector clip 12 in place relative to the fuse clip 11, and relative to the fuse block 13, upon assembly as same passes through the foot 43 of the rejector clip as well.

Since the slot 38 defined in the front face of the rejector clip 12 by the ears 35, 36 is open at the top 39 and bottom 40 thereof, and since the screw holes 44, 24 in the rejector clip's foot 43 and the fuse clip's base 20 has a center line which lies in the plane of the rejector clip's front face 37, it will be noted that screwdriver 52 access to screw 14 is easily achieved to mount the assembly on the fuse block, see FIG. 3. In other words, the open-ended slot 38 from the top 39 to the bottom 40 thereof permits a screwdriver 52 to be used on the screw 14 with no screw access problem at all for the installer of the rejector fuse clip 10 assembly. This advantage to the installer is important in field installations as it simplifies those installations where a rejector fuse clip assembly 10 is required.

After the rejector fuse clip 10 has been fixed in place on the fuse block 13 by the mounting screw 14, the grooved ferrule end 16 of a cartridge fuse 15 may be connected therewith. Such interconnection is achieved simply by orienting the annular groove 53 in the cartridge's ferrule in a coplanar manner with the ears 35, 36 of the rejector clip 12. Thereafter, the cartridge fuse's grooved ferrule 16 is pressed downwardly to spread the fuse clip's legs 21, 22 apart until same is located between and gripped by the outwardly bowed portions 27 of the fuse clip 11, see FIG. 4. Of course, the presence of the rejector clip's ears 35, 36 prevent insertion of a cartridge fuse 15 having no groove in its ferrule end, thereby providing the rejection function of the rejector fuse clip assembly 10.

Having described in detail the preferred embodiment of my invention, what I desire to claim and protect by Letters Patent is:

1. A rejector fuse clip assembly comprising:

a fuse clip having opposed spring legs, each of said spring legs defining a vertically oriented slot; and a rejector clip having opposed ears located in coplanar, but separate, relation one with the other, one of said coplanar ears being receivable in each of said vertically oriented slots, and having connector structure rigidly connecting said ears one with the other, said connector structure partially surrounding said fuse clip exteriorly thereof to positively limit outward movement of said fuse clip spring legs beyond a specified point, and said connector structure cooperating with said ears to establish an open-ended slot between said ears, said ears and connecting structure collectively operating to prevent, independently of said fuse clip legs, insertion of a nongrooved fuse terminal between said fuse clip legs, said fuse clip legs contributing nothing to said nongrooved fuse terminal insertion prevention.

2. A rejector fuse clip assembly as set forth in claim 1, said connector structure including a rear face disposed parallel to and spaced from said coplanar ears, and a shoulder connecting each of said ears with an edge of said rear face, thereby providing a block C-shaped configuration when said rejector clip is viewed from the top thereof.

3. A rejector fuse clip assembly as set forth in claim 2 wherein said vertically oriented slots in each of said spring legs is positioned substantially midway between the front and rear edges of said fuse clip.

4. A rejector fuse clip assembly as set forth in claim 2 wherein each of said spring legs includes an outwardly bowed portion adapted to receive a fuse's ferrule end, and wherein the height of that vertically oriented slot in each of said legs traverses at least the bowed portion of said leg.

5. A rejector clip structured for use with a fuse clip of the type having vertically oriented slots in opposed spring legs thereof, said fuse clip and rejector clip in structural combination establishing a rejector fuse clip assembly, said rejector clip comprising:

two planar ears oriented in coplanar relation one with the other, said ears cooperating to define a slot therebetween open at both the top and the bottom of the rejector clip's front face as defined by said ears;

a rear planar section spaced from and disposed substantially parallel to the front face defined by said ears; and a pair of planar shoulders each disposed transversely to said rear section and said front face, said shoulders connecting different ones of said ears with said rear face;

said ears being adapted to be received in said fuse clip's slots, and said rear wall and shoulder being located exteriorly of said fuse clip, when said rejector clip is assembled with said fuse clip, said planar ears, shoulders and rear section being integral and formed of a unitary generally uniform thickness metal sheet with the joints between said ears and shoulders and between said rear section and shoulders constituting angulations in said sheet.

6. A rejector fuse clip assembly as set forth in claim 5, said connector structure wherein said shoulders connect each of said ears with an edge of said rear face, thereby providing a block C-shaped configuration when said rejector clip is viewed from the top thereof.

7. A fuse clip for use with cylindrical cartridge fuses of the type having two end terminals, one of said end terminals having an annular groove therein wherein the diameter of said end at the location of said groove is smaller than the diameter of the remainder of said terminal, said fuse clip permitting the insertion of only those end terminals having said annular groove, said fuse clip comprising:

a main body member including spaced, generally parallel flexible clamping arms having opposing contact surfaces for engaging opposite sides of said end terminal, said clamping arms having aligned slots therein, said body member including a base connecting said clamping arms; and a rejection member comprising a back portion and a pair of spaced, generally parallel rigid holding arms extending outwardly from said back portion in a generally C-shaped configuration, each of said holding arms having an inward extension extending toward the other of said holding arms and generally parallel to said back portion, said inward extensions being positioned in said clamping arm slots, said inward extensions being spaced apart a distance greater than the diameter of said end terminal at the location of said annular groove and a distance less than the diameter of the remainder of said end terminal, whereby said cartridge fuse can be inserted into said fuse clip when said annular groove is positioned between said inward extensions.

* * * * *